United States Patent [19]

Landwehrkamp et al.

[11] 4,050,228

[45] Sept. 27, 1977

[54] SLIVER SUPPLY APPARATUS FOR RESOLVING ROLLERS IN OPEN END SPINNING MACHINES

[75] Inventors: Hans Landwehrkamp, Lenting; W. Gerhard Hoeber, Ingolstadt-Oberhaunstadt; Georg Goldammer, Gaimersheim; Rudolf Oexler, Ingolstadt, all of Germany

[73] Assignee: Schubert & Salzer Maschinenfabrik Aktiengesellschaft, Ingolstadt, Germany

[21] Appl. No.: 658,081

[22] Filed: Feb. 13, 1976

[30] Foreign Application Priority Data

Feb. 13, 1975 Germany ..... 2506058

[51] Int. Cl.[2] ..... D01H 1/12

[52] U.S. Cl. ..... 57/58.95

[58] Field of Search ..... 57/58.91, 58.95

[56] References Cited

U.S. PATENT DOCUMENTS

| | | | |
|---|---|---|---|
| 3,439,488 | 4/1969 | Bacil et al. | 57/58.95 |
| 3,732,681 | 5/1973 | Kutscher et al. | 57/58.95 |
| 3,762,144 | 10/1973 | Didek et al. | 57/58.91 |
| 3,864,902 | 2/1975 | Wehling et al. | 57/58.95 |

*Primary Examiner*—Richard C. Queisser
*Assistant Examiner*—Charles Gorenstein
*Attorney, Agent, or Firm*—Robert W. Beach; R. M. Van Winkle

[57] ABSTRACT

Mechanism for supplying sliver to a resolving roller is adaptable to slivers having different average staple fiber lengths by selectively engaging a plurality of clamping members to provide a selectable nip line between a sliver supply roller and its cooperating member at different distances from the resolving roller corresponding to the sliver average staple length. Either the selected clamping member or the counter member is the supply roller. Selection of the desired nip line may be made by moving one or more clamping members and the counter member relatively, by selection of one of a plurality of feed nozzles, or by selective positioning of a movable feed nozzle. The nip line selection may be effected at individual spinning stations or simultaneously for a plurality of spinning stations.

25 Claims, 20 Drawing Figures

Fig.13
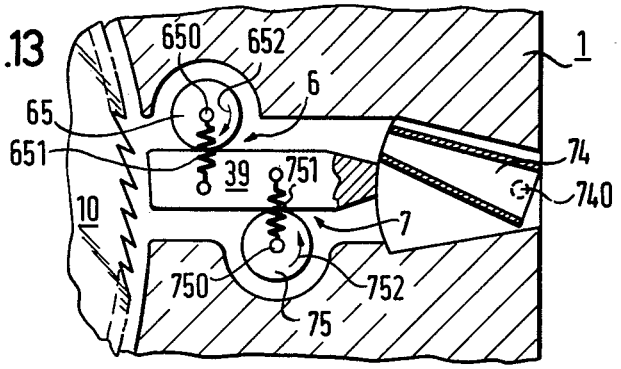
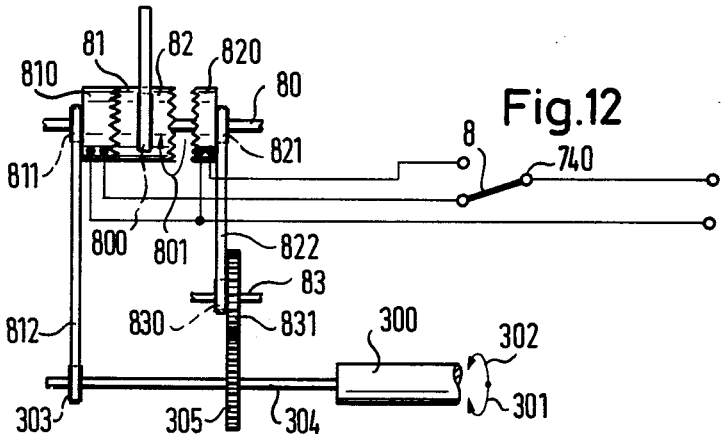
Fig.12
Fig.16
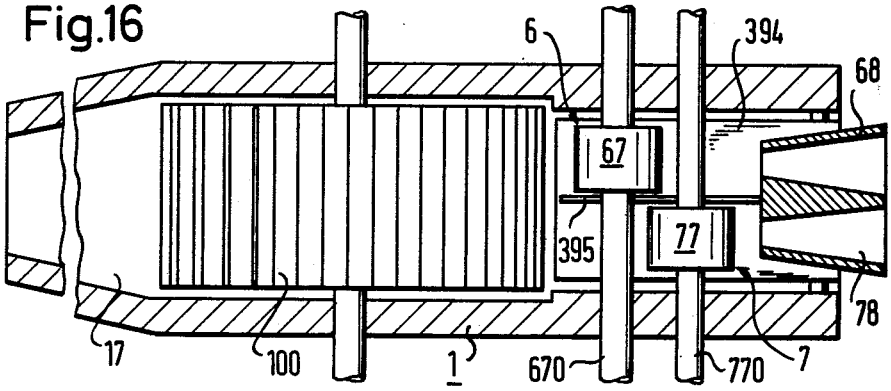

SLIVER SUPPLY APPARATUS FOR RESOLVING ROLLERS IN OPEN END SPINNING MACHINES

BACKGROUND OF THE INVENTION

1. Field of the Invention

This invention relates to a mechanism for supplying sliver to the fiber resolving roller of an open end spinning device which supply mechanism is adjustable for adaptation to slivers having different average stable fiber lengths.

2. Prior Art

In open end spinning devices, fiber sliver is conventionally fed by a supply roller and a cooperating pressure member to a resolving roller. The resolving roller has needles, teeth or an otherwise roughened periphery for resolving sliver into individual fibers which are then fed to a fiber collection surface for spinning into thread or yarn. The present invention relates to the mechanism for supplying sliver to the resolving roller, and the drawings show such apparatus in relation to a fragmentary portion of a typical resolving roller. Representative fiber transport and spinning apparatus used with such a resolving roller is shown in U.S. Pat. No. 3,797,218.

Apparatus has been previously disclosed for altering the distance between the sliver supply device and the resolving roller by resetting or exchanging parts in order to adapt to slivers of different average staple fiber lengths. U.S. Pat. No. 3,439,488, West German patent application Publication No. 2 136 178). The prior devices which utilize an exchange of parts require partial dismantling of the resolving device housing in order to afford access to the parts to be exchanged. Such parts exchange is very time consuming and must be done at each spinning station of a multiple station spinning machine. Even those devices which can be reset without dismantling the machine housing require a great deal of time, and, as a rule, must be reset station by station. In modern spinning machines having a large number of spinning stations, such adjustments are inordinately time consuming.

West German patent application Publication (offenlegungsschrift) No. 2 036 007 shows a device with two clamping elements at different distances from a resolving roller. However, the clamping element closer to the resolving roller cannot be rendered inoperative to adjust the device for clamping long staple fiber solely at a distance from the resolving roller equal to the average staple length.

West German patent application Publications (Auslegeschrift) Nos. 1 099 409 and 1 160 764 show other types of fiber sliver supply devices. However, the devices include expensive and complicated gear units which must be provided at each spinning station making the devices impractical.

SUMMARY OF THE INVENTION

For brevity in the following description and claims, some definitions of terms used herein are set forth here. "Short staple sliver" means sliver having fibers whose average length is short, and the term "short" is recognized in the art. Similarly, "medium staple" or "long staple" sliver describes the average length of the fibers in the sliver. The "clamping and counter members" constitute cooperating members for feeding the sliver to the resolving roller. One of the cooperating members is a driven roller, and the other cooperating member may be a planar member, a complementary arcuate member, a roller, either a driven roller, an idler roller or a stationary roller, or some other configuration whereby the driven roller and its cooperating member form a "nip line" by which the sliver is "clamped" and moved in a controlled manner toward the resolving roller by rotation of the driven roller. As used herein, "clamped" or "clamping" is used in the relative sense of being gripped, rather than in the absolute sense of being held stationary, i.e. when sliver is clamped by a clamping member and the counter member such sliver is linearly movable by rotation of one of such cooperating members.

It is the principal object of the present invention to provide sliver supply apparatus for a resolving roller which permits adjustment for silvers having different fiber staple lengths in a simple and rapid manner.

Another important object is to provide apparatus by which such adjustment for several spinning stations can be made simultaneously at a single location.

A further object is to provide such apparatus which is simple in construction.

The foregoing objects can be accomplished by providing in a sliver supply apparatus a plurality of nip locations at which the sliver can be engaged between a driven roller and a cooperating pressure member, each of such locations being spaced at a different interval from the resolving roller. At each location either the driven roller or the clamping member is movable into or out of working engagement with the other cooperating member and sliver in the feed path. The movable member can be connected to setting linkage operable at its individual spinning station, or such setting linkage can be interconnected by a rod or cam with corresponding linkages of several spinning stations for simultaneous setting by a central setting device. A particularly simple construction is to provide a plurality of movable members, one for each nip location, and a common counter member. The nip locations can be staggered axially of the resolving roller, can be on different circumferentially spaced radial planes of the resolving roller, or can be in tandem on a common radial plane. In a tandem arrangement having two selectable nip locations, the movable member nearer the resolving roller is preferably mounted so that it can be swung about an axis toward and away from the counter member. In a preferred embodiment both movable members would be carried by a common holder so that the movable members are alternately engageable with the counter member by swinging the holder. Advantageously, the two movable members would be mounted symmetrically with respect to the axis of swing of the holder. The movable members can be especially simply made by forming a leaf spring with two salient bends selectively engageable with the counter member.

In another embodiment of the invention, two driven rollers are engageable respectively with opposite sides of a feed plate to define two nip locations. The appropriate nip location is selected by swinging a sliver supply funnel into a position to feed sliver to the side of the feed plate corresponding to the desired nip location. In this arrangement, a sliver clamping lever corresponding to the working nip location is set for operation by a switch actuated by positioning of the swingable supply funnel. When sliver feed is to be stopped, a further switch actuates the clamping lever to move it into engagement with the sliver and the feed plate, whereby the sliver is clamped against the feed plate and the feed plate is pressed out of working engagement with the working roller.

In order to confine the sliver within a limited region adjacent to the resolving roller, the counter member may have flanges spaced axially of the resolving roller between which flanges the movable member nearest to the resolving roller can be received. The counter member and flanges form the bottom and sides of a sliver guiding channel and the movable member closes at least a portion of the top of the channel whether it is in its working or its nonworking position relative to the counter member. It is preferred that the counter member carrying the flanges be a driven roller and the movable member be an idler roller having a synthetic covering frictionally engageable with the flanges, whereby the idler roller is rotated. In this manner, both cooperating elements at a nip location have rolling contact with the sliver which substantially eliminates abrasion and resulting damage to the external fibers in the sliver.

Whatever the particular embodiment of the cooperating clamping and counter members, it is preferred that the movable member be connected by appropriate linkage such as levers, or cams and rods, to corresponding members of other aligned spinning stations in a multiple station spinning machine so that the setting of the movable member of one spinning station simultaneously effects corresponding settings at the other spinning stations.

The apparatus of the present invention makes it possible to set the supply device in a very simple manner so that spinning apparatus can be quickly altered from conditions suitable for spinning fibers of one average staple length to conditions suitable for fibers of a different average staple length.

BRIEF DESCRIPTION OF THE DRAWINGS

FIG. 12 is a schematic diagram of the reversible drive mechanism for the common counter element.

FIG. 13 is a transverse section through still another embodiment of apparatus having independent clamping members.

FIG. 16 is a plan of sliver supply apparatus using axially staggered independent clamping means, with parts in section.

DETAILED DESCRIPTION

Figure 1:
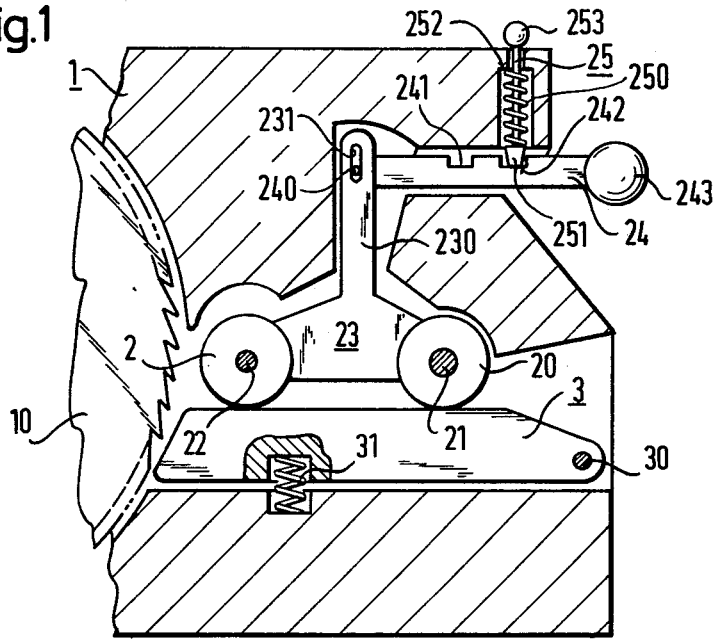
FIG. 1 is a transverse section through sliver supply apparatus of the present invention showing parts in a first position suitable for feeding short staple fibers to a resolving roller.

While the drawings show the sliver supply mechanism disposed so that the sliver would be fed along a substantially horizontal path to the resolving roller and the clamping members are selectively and relatively movable toward and away from the counter member in a generally vertical direction, the respective directions of movement are relative to the resolving roller. The supply mechanism could be disposed at any location circumferentially of the resolving roller. Consequently, movement will be described as "radially inward" if it is generally toward the axis of the resolving roller, "radially outward" if it is generally away from such axis, and "circumferentially" if movement is transversely of radial movement, whether such movement is along a path which is concave, straight or convex relative to the adjacent peripheral portion of the resolving roller.

In the housing 1 for the resolving roller 10, sliver supply apparatus is also contained. In accordance with the present invention, the embodiment of the supply apparatus shown in FIGS. 1 and 2 includes a short staple clamping element 2 and a long staple clamping element 20 which are engageable with a counter member 3. Each clamping member 2 or 20 forms with counter member 3 a nip line by which sliver is fed to resolving roller 1. While, as will be seen in the succeeding description of other embodiments, the counter member and the clamping members can take various forms, in each instance one of the cooperating members 2, 3 or 20, 3, or their analogous parts in other embodiments, will be a driven roller by which sliver clamped at the nip line will be fed toward the resolving roller 10.

Figure 2:
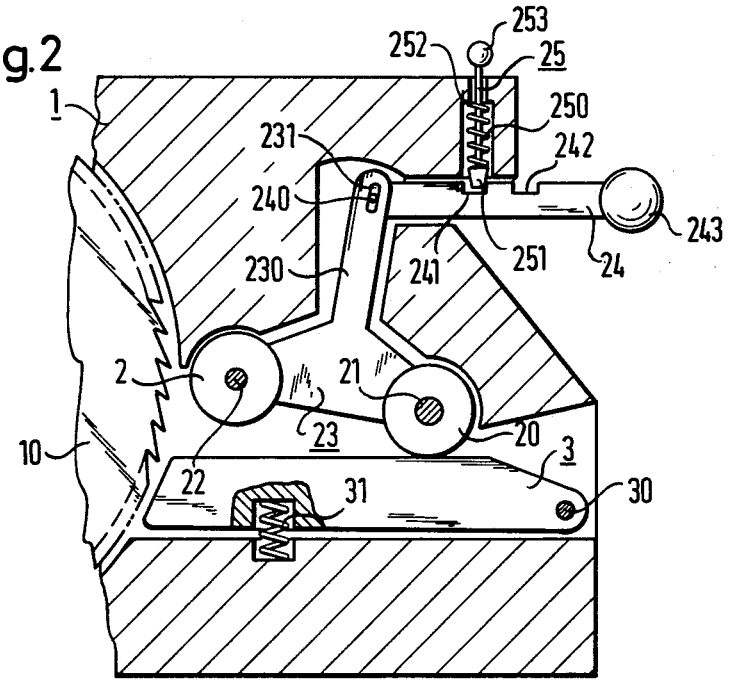
FIG. 2 is a similar view showing parts in a second position suitable for feeding long staple fibers.

In FIGS. 1 and 2, the clamping members 2 and 20 are driven rollers and counter element 3 is a feed plate spanning between and of a length greater than the distance between the shafts 22 and 21 of rollers 2 and 20. Feed plate 3 is mounted at its end remote from resolving roller 10 on a pivot 30. The free end of plate 3 is supported and pressed toward rollers 2 and 20 by compression spring 31 reacting between plate 3 and housing 1.

Shaft 21 of clamping roller 20 has a fixed axis but is rotatable to drive roller 20 and through suitable gearing (not shown) to drive shaft 22 and its roller 2 at the same speed. A holder 23 is loosely mounted on shaft 21 by a bearing for swinging about such shaft without being rotated by it. Such holder supports shaft 22 and its roller 2 for swinging about the axis of shaft 21. Holder 23 includes an arm 230 substantially perpendicular to a line connecting shafts 21 and 22, which arm has a slot 231 receiving a pin 240 carried near the inner end portion of a linearly displaceable arm 24 having a knob 243 on its outer end. A pin 25 having a knob 253 on one end and a detent 251 on its opposite end extends through housing 1 and is normally urged into engagement with arm 24 by compression spring 250 reacting between shoulder 252 of the housing and detent 251. Notches 241 and 242 cooperate selectively with detent 251 to latch the holder in the respective positions by which short staple clamping member 2 is maintained out of working position (FIG. 2) or in working position (FIG. 1). Clamping roller 2 is moved out of working engagement with counter member 3 from the position of FIG. 1 to that of FIG. 2 by displacing arm 24 lengthwise away from resolving roller 10 while latch pin 25 is held out of engagement with notch 242.

If short staple fibers are spun, the supply apparatus is set in the condition of FIG. 1, in which the clamping element 2 located closer to the resolving roller 10 and the remote clamping element 20 are in working position supported on the common counter element 3. Sliver (not shown) is fed through the funnel shaped opening between the outer end of member 3 and housing 1 to the outer nip line between member 3 and roller 20. Roller 20 driven by shaft 21 advances the sliver toward the inner nip line between roller 2 and counter member 3 where the sliver is again positively advanced by rotation of roller 2 driven synchronously with roller 20, as described above, toward resolving roller 10 by which the sliver is resolved into individual fibers in a conventional manner.

The distance between the resolving roller and the inner nip line formed by clamping member 2 and counter member 3 is determined by the average length of the fiber in a sliver characterized in the art as short staple. The distance between the resolving roller and the outer nip line formed by clamping member 20 and counter member 3 corresponds to the average fiber length commonly known in the art as long staple. As can be readily seen from the above description, the setting mechanism 23, 24, 25 can be used to adapt the sliver supply apparatus for short or long staple fiber and back again in a simple, virtually instantaneous manner so that the resolving device and its associated spinning device can be utilized with much greater flexibility than heretofore.

The supply apparatus of FIGS. 1 and 2 can be varied in a number of ways. For example, setting mechanism 23, 24 can be utilized to set the supply apparatus for a row of spinning stations simultaneously (FIG. 18) simply by connecting together the outer ends of arms 24 by a rod running the length of the machines and by providing a latch pin 25 at only one spinning station. Alternatively, the latch mechanism 25 can be eliminated and a cam shaft connected to knob 243 could be used to shift arm 24 between its inner and outer positions. If greater positive control of the sliver is desired, feed plate 3 could be provided with arcuate depressions complemental to the periphery of rollers 20 and 2 so that sliver would be clamped between the roller and feed plate along a greater portion of its length.

Figure 3:
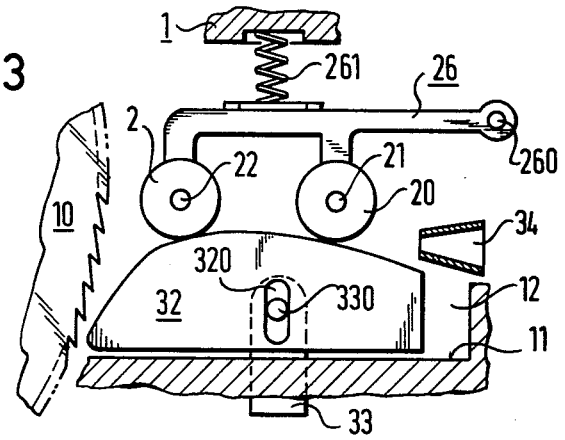
FIG. 3 is a schematic transverse section through another embodiment of the present invention in which the counter member is adjustable.

In FIG. 3, the clamping elements 2 and 20 are again shown as driven rollers supported by an elongated holder 26, the outer end of which is swingably supported on a fixed pin 260. Compression spring 261 reacting between housing 1 and holder 26 normally presses rollers 2 and 20 toward the convex upper surface of counter member 32. As will be seen shortly, the axes of both shafts 21 and 22 must be movable through a short distance so that the drive for the shafts must be flexible such as a chain drive having a tightener to take up chain slack. Counter member 32 has a ramp sharply sloping away from holder 26 between inner roller 2 and resolving roller 10. Member 32 rests on a slide surface 11 of the housing 1 and is slidable toward and away from the resolving roller. A slot 320 in counter member 32 having its length generally perpendicular to the direction of movement of such member, embraces a pin 330 of a lever 33 by which radial movement of the counter member is effected.

In the position shown in FIG. 3, member 32 is in its inner position in which both rollers 2 and 20 are engaged with its upper surface. The portion of the counter member convex surface spanning between rollers 2 and 20 has a ramp sloping gently downward away from the resolving roller 10. When long staple sliver is to be supplied to resolving roller 10, lever 33 is swung to shift counter member 32 outward from the resolving roller, whereby roller 20 is wedged upward by the gently sloping ramp of member 32, thereby lifting roller 2 out of engagement. The steep ramp on the inner end of member 32 assures a substantial gap between it and roller 2 so that in its outer position counter member 32 engages only roller 20.

The mechanism for moving lever 33 is not shown but could be a displaceable arm such as shown in FIG. 1 or a bell crank. Because of the variable gap 12 between the outer end of member 32 and the housing, it is preferred that a funnel 34 be supplied of a length spanning the maximum extent of the gap in the direction of sliver travel. The sliver passes through such funnel to prevent a sliver from sagging into gap 12.

The embodiment of FIG. 4 again shows the clamping elements as rollers 2 and 20 and, like the construction of FIG. 3, the adjustment between the short and long staple sliver conditions is effected principally by movement of the counter member. In this instance, roller 2 is mounted on shaft 22 having a fixed axis. Roller 20 is continuously held in engagement with counter member 35 by a tension spring 27 connecting the movable axis shaft 21 to the housing (not shown). The elongated counter member 35 is swingable about pivot 350 supporting its outer end. Its inner end portion is held by tension spring 351 in engagement with the periphery of an eccentric disk cam 353 carried on shaft 352.

Figure 4:
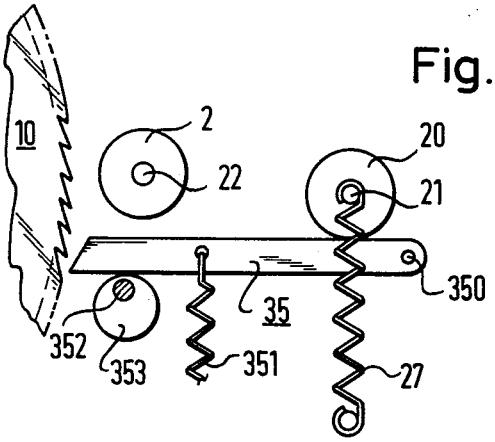
FIG. 4 is a schematic transverse section of a further embodiment in which the counter element is adjustable by a rotatable cam.

In the condition shown in FIG. 4, the supply apparatus is set for use with long staple sliver. To adjust for short staple sliver, disk 353 is rotated through 180° to press counter member 35 in opposition to spring 351 in engagement with inner roller 2. Since roller 20 remains in engagement with the counter member, sliver would be positively guided by both rollers 20 and 2.

Figure 5:
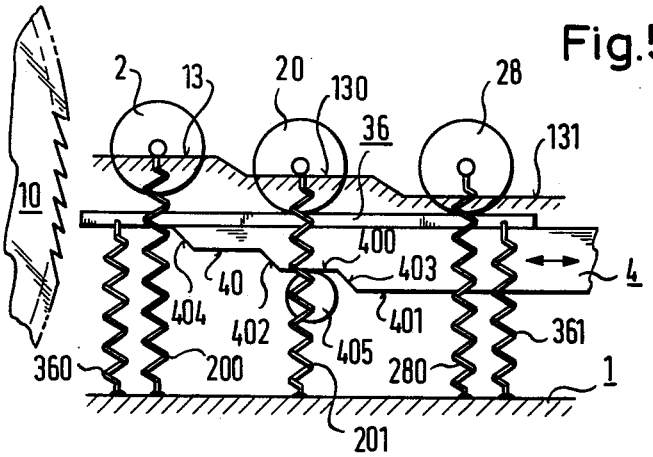
FIG. 5 is a schematic transverse section of still a different embodiment in which the counter element is adjustable by a shiftable cam track.

If slivers having a variety of average staple lengths which deviate greatly from the shortest to the longest average staple lengths are to be processed, a greatest number of settings may be desirable than provided by only two clamping elements. The construction of FIG. 5 provides for three nip lines at different intervals from the resolving roller 10 and could be extended to provide additional settings. Again, the common counter element 36 cooperates selectively with one or more clamping rollers 2, 20 and 28. As in FIGS. 3 and 4, the adjustments are made by moving the counter member. One side of a cam track 4 has stepped cam surfaces 40, 400 and 401, selectively engageable with a fixed rod or wheel 405 by displacement of track 4 radially of resolving roller 10. The opposite side of the cam track carries counter member 36, which functions as a feed plate and is maintained in contact with track 4 and track 4 is maintained in contact with rod 405 by tension springs 360 and 361 connecting inner and outer ends of counter member 36 to housing 1. These shafts of clamping rollers 2, 20 and 28 are supported on respective stepped supports 13, 130 and 131 to limit movement of the rollers toward counter member 36 by the force of tension springs 200, 201 and 280, respectively connecting the roller shafts with housing 1. Support 131 could be eliminated since roller 28 will always rest on counter member 36 so long as track 4 is not moved outward beyond rod 405.

If long staple sliver is to be processed, then only the clamping roller 28 most remote from resolving roller 10 should be engaged with counter member 36. This condition is effected by shifting track 4 outward so that rod 405 moves from cam surface 400 along connecting ramp 402 to cam surface 40. Member 36 will be drawn toward rod 405 and away from rollers 2 and 20, which rollers will be checked by their respective supports 13 and 130, while roller 28 is held by its spring 280 in engagement with the counter member. To set the supply apparatus for processing short staple sliver track 4 is shifted toward resolving roller 10 so that cam surface 40, ramp 402, cam surface 400, ramp 403 and finally cam surface 401 will move over rod 405, whereby counter member 36 is pressed toward the clamping rollers in opposition to springs 360 and 361 to the other extreme position in which all three rollers 2, 20 and 28 engage counter member 36.

If a medium staple sliver is to be processed, cam track 4 is moved to the position shown in FIG. 5, whereby rollers 20 and 28 are engaged with member 36 while clamping roller 2 nearest resolving roller 10 is held out of engagement by support 13.

If desired, cam track 4 and rod 405 could be eliminated, counter member 36 could be mounted like counter member 35 in FIG. 4, and eccentric wheel 353 could be replaced by a cam provided with three lobes spaced at different radial distances from the axis of cam shaft 352.

In all of the preceeding embodiments of the present invention the clamping elements have been rollers and the counter member has been shown as a feed plate. It is also possible to have the counter member provided as a roller and the clamping elements take various forms other than driven rollers.

Figure 6:
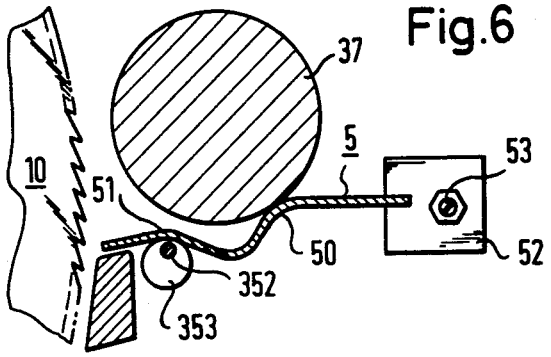
FIG. 6 is a schematic transverse section through an embodiment in which the clamping members are salient bends in a leaf spring.

In accordance with FIG. 6, the counter element 37 is a roller which can be mounted and driven in conventional manner. For example, a continuous drive roller 37' (FIG. 18) may extend the length of the spinning machine through the housings of the several spinning stations S, being an integral part of said drive roller 37'.

The clamping members 50 and 51 are salient bends in a cantilever leaf spring 5 having one end attached to a bearing block 52 on an axle 53. Clamping member 50 will constantly engage counter member 37, while clamping member 51 is selectively pressed against member 37 in accordance with the selected rotative position of eccentric wheel 353 on its shaft 352. While eccentric wheel 353 is shown as backing leaf 5 directly behind the nip line formed between clamping member 51 and counter member 37, such eccentric wheel could be located along the leaf 5 either closer to or more remote from resolving roller 10. In either case there would be more resilience of leaf 5 at the nip line, which may be desired to reduce the pressure and consequent abrasion on the sliver passing such nip line.

Figure 7:
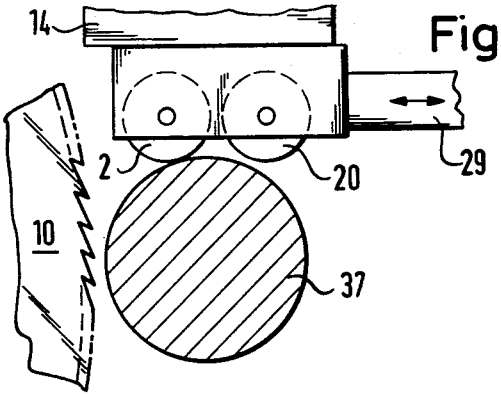
FIG. 7 is a transverse section of another embodiment in which the clamping members are set by shifting a common holder along a linear path.

Similar to FIGS. 1 and 2, the clamping elements in FIG. 7 are rollers 2 and 20 carried by a common holder. In this instance, however, because the counter member is also a roller instead of plate, only one clamping member 2 or 20 will engage the counter member at a time. The holder is a radially extending bar 29 slidable lengthwise in a guide 14 toward and away from the resolving roller.

Again, with a common holder arrangement, bars 29 of several spinning stations can be interconnected easily and shifted by cam means, by a bell crank, or by a lever having one end pivotally connected to a bar 29 and the other end supported on a fixed pivot, for example.

Instead of a driven roller 37, the counter member could take various forms such as the counter element 32 in FIG. 3. In this case, rollers 2 and 20 would be driven by suitable drive means (not shown) such as, for example, a pair of friction drive rollers located between rollers 2 and 20 in positions such that the appropriate drive roller engages the selected clamping element engaged with the counter element. Furthermore, if the counter element is a roller 37, the clamping elements carried by holder 29 need not be rollers but could be flat plate members disposed tangentially to the corresponding nip line locations on roller 37, or could be bent plates like elements 50 and 51 of FIG. 6, or could be complementary arcuate members like elements 54 and 55 of FIG. 8.

Figure 8:
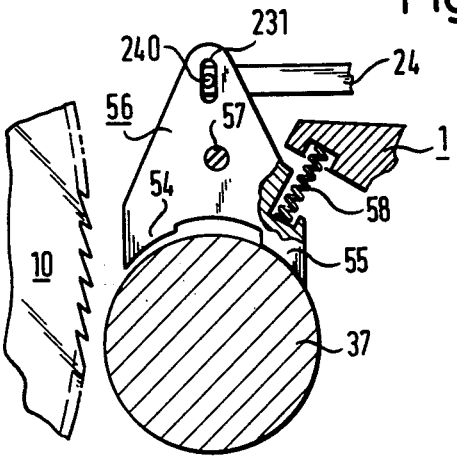
FIG. 8 is a transverse section of still a different embodiment in which the clamping members are located on a common holder symmetrically about a holder swinging axis.

In FIG. 8, the clamping members 54 and 55 are arcuately concave, complemental to the adjacent peripheral portion of counter element roller 37, are carried on a swingable holder 56 and are arranged symmetrically with respect to pivot 57 about which the holder swings. The holder can be swung by translation of an arm 254 carrying a pin 240 projecting into slot 231 in holder 56 in the manner described in connection with FIG. 1. If a cam (not shown) is engaged with the outer end of arm 24 remote from roller 10, compression spring 58 normally tends to swing holder 51 in a clockwise direction about pivot 57 and would, therefore, urge arm 24 into engagement with such a cam. Of course, other spring biasing means could be used to maintain contact between arm 24 and an actuating cam.

Figure 9:
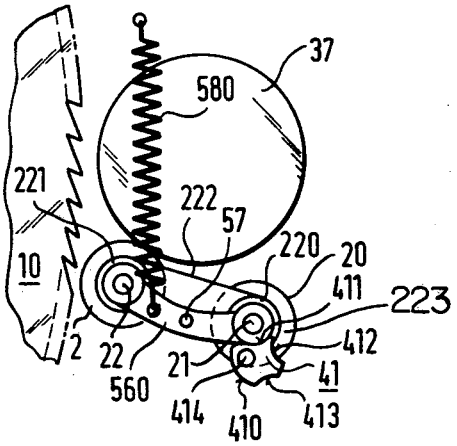
FIG. 9 is a variation of the clamping members and swinging holder of FIG. 8.

In the embodiment of FIG. 9, clamping rollers 2 and 20 are carried by a holder 560 and are symmetrically arranged about the holder pivot 57 for alternate engagement with a counter element 37. This construction differs from previous embodiments principally in the mechanism for varying the pressure with which the clamping element bears against the counter element. For this purpose, it is preferred that the peripheries of rollers 2 and 20 be of resilient material. A boss 223 encircling shaft 21 of roller 20 engages a cam 41 mounted on an eccentric shaft 414. The cam and boss are maintained in engagement by tension spring 580 connected between the housing (not shown) and an arm holder 560. The cam surface 410 and 411 closest to eccentric shaft 414 determine two possible pressure settings when roller 2 is engaged with counter element 37. If cam 41 is rotated so that either cam surface 412 or 413 engages boss 223, roller 20 will be pressed against counter element 37 in opposition to the force of spring 580, the pressure of roller 20 effected by cam surface 412 being different than that effected by cam surface 413.

A variation of the embodiment described in FIG. 9 is to provide a wheel 211 on shaft 22 of clamping roller 2 and a wheel 220 on shaft 21 of clamping roller 20 and to interconnect such wheels by a chain 222, belt, friction or gear wheel, whereby roller 20 is rotated conjointly with roller 2, the latter being rotated when it engages driven counter member 37. In this manner movement of sliver being fed to the short staple nip line between inner roller 2 and counter member 37 is facilitated by placing the leading sliver end on roller 20 and permitting such roller to help advance the sliver toward roller 2.

Figure 17:
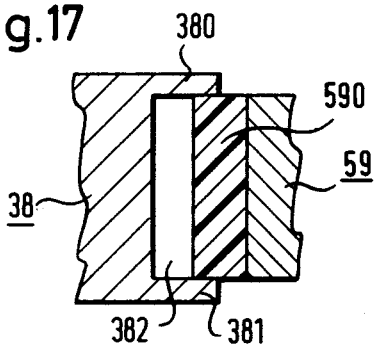
FIG. 17 is a fragmentary diametral section through a modified form of a cooperating counter member and clamping member.

In order to provide reliable guidance of the leading end portion of the sliver adjacent to resolving roller 10, whether or not the short staple clamping member is in or out of working engagement with the counter member, FIG. 17 shows a cooperating structure for maintaining a guide passage 382 of substantially rectangular cross section. The counter element 38 has flanges 380 and 381 projecting substantially perpendicular to the nip line forming surface, which flanges are spaced apart to embrance closely the margins of clamping element 59. Element 59 is slidable relative to the flanges for movement between its working position engaged with counter element 38 and its nonworking position (shown in FIG. 17) spaced from the body of such element. Such guide channel flanges may be provided to cooperate with each of the plurality of clamping elements, although the provision of an enclosed guide channel is especially desirable at the location of the clamping element closest to the resolving roller. The clamping elements can be either rollers or feed plates.

In the preferred form of sliver guide channel construction, the counter element 38 carrying flanges 380 and 381 is a driven roller. The first and second clamping elements 59 (one of which is not shown in FIG. 17) are idler rollers having a peripheral coating 590 of suitable material to effect frictional engagement with flanges 380 and 381 so that rotation of driven roller 38 will effect rotation of clamping rollers 59. If both the counter element and the clamping element are rotated, the sliver passing through guide channel 382, whether clamping element 59 is in working or nonworking position, is subject only to roller friction and the fibers in the sliver are spared from the brasion or disorientation effected by sliding friction.

In the forms of invention described herein above, sliver is fed along the same path whether the supply apparatus is set for short staple, intermediate staple or long staple sliver and the corresponding nip line locations on the counter element are in tandem. However, it is also possible to provide independent sliver feed paths by locating the respective clamping elements in circumferentially spaced positions relative to the resolving roller with counter elements interposed between each pair of clamping elements. As before, the nip lines defined by the various clamping members are spaced different distances from the resolving roller periphery corresponding to the different average staple fiber lengths to be accomodated to the supply apparatus. FIGS. 10, 11, 13, 14 and 16 show various embodiments of this form of the invention. In these embodiments each set of cooperating clamping and counter elements is maintained in engagement and setting is accomplished by mechanism for selecting the appropriate sliver path.

Figure 10:
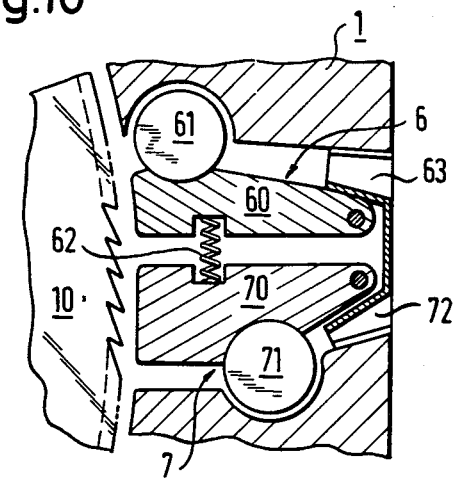
FIG. 10 is a transverse section through sliver supply apparatus having independent clamping members on opposite sides of the counter member.

In the form shown in FIG. 10, there are two independent sliver feed paths 6 and 7. The counter members are driven rollers 61 and 71. In order to provide simple construction for maintaining the respective cooperating elements in continuous working condition, the cooperating clamping members 60 and 70 are cantilever feed plates pivotally mounted at their outer ends and a compression spring 62 reacting between them spreads the free ends of the feed plates 60 and 70 to urge such plates into engagement with their respective clamping members 61 and 71.

The feed path appropriate for guiding sliver of shot or long staple length is selected by utilizing the appropriate supply funnel 63 or 72. A swingable funnel, 74 such as shown and described in connection with FIGS. 11 and 13, could be located outside housing 1 for selective alignment with funnel 63 or 72.

The basic advantage of all the embodiments of the present invention, is to guide sliver positively to a location from the resolving roller corresponding to the average staple fiber length in the sliver to be resolved. In this manner the resolving roller effectively operates only on the leading end of the sliver. Consequently, fibers are not loosened from the sliver in the region of the supply apparatus where such fibers are lost to wastage and create unnecessarily high cleaning and maintainence expence by clogging the supply mechanism. On the other hand, by selecting the optimum distance from the resolving roller, fibers in the leading end of the sliver are released without unnecessary tearing, which would be caused by having one end of a fiber restrained by the supply apparatus and the other end beaten by the teeth of the resolving roller. In addition, by providing independent sliver paths, sliver passing through the supply apparatus will be subjected to fewer surfaces on which it may slide or catch, thereby reducing abrasion and sluffing off of surface fibers. Furthermore, the fewer moving parts inside the supply apparatus, the less the tendency for parts to be worn or clogged by fibers which do sluff off or otherwise escape from the sliver and the less frequently cleaning and maintainance is required.

Figure 11:
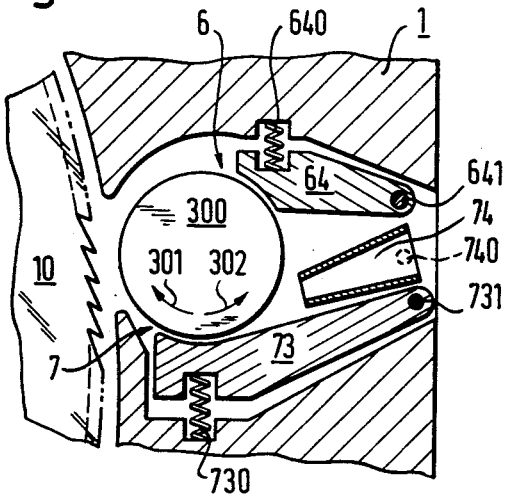
FIG. 11 is a transverse section through another embodiment of apparatus having independent clamping members.

It is not necessary that the supply apparatus for each of the two feed paths be separate sets of components. In FIG. 11 the counter member 330 is common to the two clamping members 64 and 73. In this instance the counter element is a driven roller engaged by two pivotable cantilever feed plates 64 and 73 disposed so that the nip lines are on opposite sides of a diametral plane through roller 300 and the axis of resolving roller 10. The clamping members 64 and 73 are maintained in contact with counter member 300 by compression springs 640 and 730 reacting between housing 1 and the respective clamping members.

Selection of the desired feed paths 6 or 7 is made by shifting the outer end of infeed funnel 74 to direct sliver fed through it toward the selected nip line. For this purpose funnel 74 is pivotally mounted at 740 adjacent to its infeed end. It should be noted that the feed plates in FIGS. 10 and 11 are reversed. In FIG. 10, feed path 6 corresponds to the nip line to be selected for short staple sliver, while feed path 7 in FIG. 11 is the short staple sliver path. It is clear, therefore, that the particular arrangement of the feed paths relative to the resolving roller radial plane passing between the feed paths is not critical.

As is evident from FIG. 11, if the short staple sliver path 7 is utilized, counter roller 30 must rotate in the direction indicated by arrow 301 in order to feed sliver toward resolving roller 10. Conversely, if the long staple fiber path is utilized, counter member 300 must rotate in the opposite direction, as indicated by arrow 302. Since the direction of rotation of roller 300 must be correlated with the position of supply funnel 74, a switch can be connected with the pivot 740 of funnel 74 to control the direction of roller rotation. A control diagram suitable for this purpose is shown in FIG. 12.

As pivot 740 turns, it moves to position switch 8 for magnetizing the corresponding section of a magnetic reversing clutch carried on a shaft 80. Such clutch includes a first energizable section 810 for effecting drive of roller 300 in direction 301, a second energizable section 820 for effecting such drive in direction 302 and a driven section 81, 82 interposed between sections 810 and 820 constantly rotated in the direction of arrow 801 by a belt drive 800. In the position of switch 8 shown in FIG. 12, the drive for roller 300 is set for direction 301. Clutch section 810 is energized to effect coupling with the driven section 81 for driving sprocket 811 carried by clutch section 810, chain 812 and sprocket 303 keyed to shaft 304 or roller 300. During this driving condition, disengaged clutch section 820, carried as an idler wheel on shaft 80, will be rotated in the direction opposite to the coupled clutch elements 81, 810. Such rotation will be effected by gear wheel 305 keyed to shaft 304, idler gear wheel 831 supported on shaft 83, sprocket 830 carried by gear wheel 305, chain 822 and sprocket 821 carried by clutch section 820.

When funnel 74 is shifted into a position aligned with feed path 6 (FIG. 11), its pivot 740 will swing switch 8 so that clutch section 810 is deenergized, the opposite clutch section is energized and driven section 81, 82 is uncoupled from section 810 and coupled with section 820 loose on shaft 80 to effect its rotation in the opposite direction 302. The inertia of the clutch, sprocket, chain and gear drive, and roller 300 will tend to brake the system so that the reversing operation is smooth and undue wear and stress on the parts is avoided.

The supply mechanism of FIG. 13 is similar to that of FIG. 12, the difference being that the common counter member is a feed plate 39. The clamping elements are roller 65, driven in the direction of arrow 652, and roller 75, driven in the direction of arrow 752, which driven rollers are located at opposite sides of the feed plate. The cooperating members are maintained in engagement by tension springs 651 and 751 connected between the feed plate and the respective roller shafts 650 and 750. Rollers 65 and 75 may be constantly driven or alternatively driven by appropriate drives, but the reversing clutch of FIG. 12 is eliminated. While a swingable funnel 74 is shown, separate funnels, such as 63 and 72 shown in FIG. 10, could be substituted.

Figure 14:
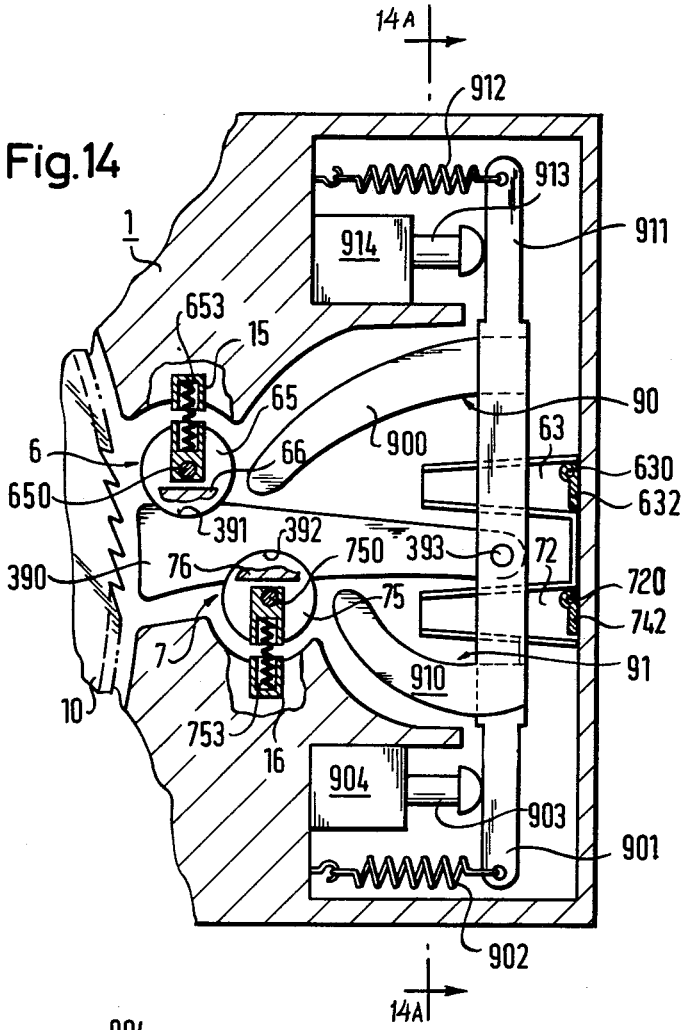
FIG. 14 is a transverse section through a modified version of the device of FIG. 13 and showing sliver feed interrupting means operable therewith.

An independent feed path supply device is shown in FIG. 14 in conjunction with solenoid operated sliver feed interrupting apparatus (see U.S. Pat. No. 3,695,022, FIG. 5). The counter element 390 is a feed plate having concave arcuate notches 391 and 392, the radii of which correspond to the radii of the cooperating clamping rollers 65 and 75. The outer end of feed plate 390 is pivotably supported by pin 393. The cooperating rollers and counter member are maintained in engagement, and the feed plate is maintained in its normal position, by opposed compression springs 653 and 753 reacting between respective housing shoulders 15 and 16 and the respective clamping rollers 65 and 75. Separate funnels 63 and 72 supply sliver to the respective short staple feed path 6 and long staple feed path 7.

Figure 14A:
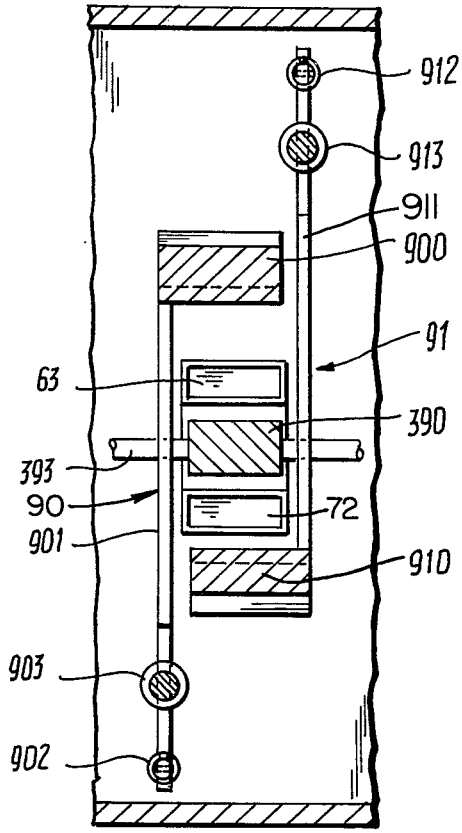
FIG. 14A is a section on line A—A of FIG. 14.

As in FIGS. 10, 11 and 13, either the counter element or the two clamping elements can be driven to effect supply of sliver to the resolving roller; and sliver supply can be interrupted by disengagement of couplings connecting the driven roller with its roller drive. However, it is preferred that sliver feed be interrupted by clamp arms 900 and 910 carried by respective leves 90 and 91 pivotally mounted on the pivot shaft 393 which supports counter member 390. As shown best in FIG. 14A, lever 90 includes an arm 900 having a width axially of resolving roller 10 corresponding to the axial width of the counter member 390, which arm, in the normal position shown in FIG. 14, is spaced from the counter member to permit passage of sliver therebetween.

Arm 900 is carried by a narrow arm 901 extending transversely of the sliver feed path from funnel 63 to the nip line between clamping roller 65 and counter member 390 and extends alongside and behind funnels 63 and 72 as viewed in FIG. 14. The end of arm 901 on the side of pivot shaft 393 opposite arm 900 is held in engagement with plunger 903 of solenoid 904 by a tension spring 902 connected to housing 1. Lever 91 and related components are of similar construction but are inverted relative to lever 90, the corresponding parts being broad counter member engaging arm 910, narrow lever arm 911, spring 912 and plunger 913 of solenoid 914. As seen best in FIG. 14A, lever arms 901 and 911 are spaced apart axially of their common pivot shaft 393 and are located on opposite sides of supply funnels 63 and 72.

When solenoid 904 is energized by a yarn breakage detection or monitoring device, plunger 903 will be projected and swing lever arm 901 in opposition to the force of spring 902 so that the lever 90 is swung about pivot shaft 393 to press the free end of arm 900 against counter member 390 and clamp the sliver therebetwen. As lever 90 is swung further, counter member 390 is also swung about shaft 393 in a direction away from shaft 650 of clamping roller 65. A stop 66 engages shaft 650 and limits movement of roller 65 urged by the force of spring 653 toward counter member 390 so that the clamping member and the counter member are disengaged. Consequently, roller 65 is ineffective for advancing or attempting to advance the sliver toward the resolving roller. Energization of solenoid 914 would operate similarly to separate counter member 390 from clamping roller 75, the shaft 750 of which is engageable with a stop 76.

Figure 15:
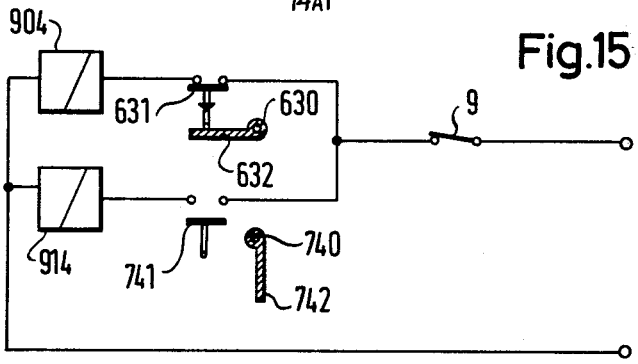
FIG. 15 is a schematic wiring diagram of the interrupting means control apparatus.

FIG. 15 is a control diagram for automatically placing the appropriate solenoid in condition for energization corresponding to the feed path being utilized. As seen in FIG. 14, the infeed ends of funnels 63 and 74 are normally closed by hinged covers 632 and 742 pivotable about hinge pins 630 and 720, respectively. Cover 632 or 742 is engageable with switch 631 or 741, respectively, when the cover is swung into a position for permitting passage of sliver through the funnel. In the illustration of FIG. 15, cover 632 has been swung into open position whereby short staple sliver can be fed to path 6 between counter member 390 and clamping roller 65. Simultaneously, switch 631 is closed connecting solenoid 904 in circuit with switch 9. Switch 9 is closed by the yarn monitoring device when it detects a break in the yarn. When switch 9 is closed, the circuit to solenoid 904 is complete and its plunger 903 will be projected to swing lever 90 in counterclockwise direction as seen in FIG. 14 to interrupt sliver supply in the manner described above.

Other variations can be constructed in accordance with the present invention. For example, it may be desired to provide three or more independent sliver feed paths each including a nip line formed between a clamping member and a counter member, the nip line of each of the various feed paths being spaced a different distance from the resolving roller than any of the other nip lines. For this purpose, the forms of FIGS. 10 and 11 could be combined by substituting the roller 300 for roller 71 and eliminating feed plate 64 so that a roller 61, feed plate 60,70, a reversible roller 300 and feed plate 73 would be disposed circumferentially of resolving roller 10. The three nip lines would be formed by the cooperating pairs of elements 61, 60; 70, 300; and 300, 73. For most applications, however, it has been found that two nip lines, one for short and other for long staple sliver, are sufficient.

While the forms having independent feed paths have been shown with all of the cooperating clamping and counter members in continuous working position regardless of which feed path might be in use, the nonoperative clamping member could be separated from the counter member during such nonuse. For example, in FIG. 14 a switch actuated by a funnel cover 632 or 742 might actuate a roller retracting arm or rotation of funnel pivot shaft 740 (FIG. 13) might actuate such a switch. In the structure of FIG. 11, gear wheels could be mounted on clamping member shafts 641 and 731 engageable with complementary gear wheels on funnel pivot 740 so that swinging of the funnel 74 and its pivot 740 would effect corresponding rotation of shafts 641 and 731 to move one clamping member toward counter member 300, and, simultaneously, move the other clamping member away from the counter member.

Providing separate feed paths 6 and 7 (FIG. 10) supplied by separate funnels 63 and 72 presents another dimension of versatility, namely, a short staple sliver and a long staple sliver could be fed to the resolving roller simultaneously. For example, a short staple cotton fiber sliver and a long staple synthetic fiber sliver could be combined to provide a blended fiber yarn. Thus a preceeding sliver drafting operation heretofore used to combine different fibers could be eliminated and the fibers would be spared the wear and tear of one stage of fiber processing.

Independent feed paths 6 and 7 are provided in FIG. 16 in spaced relationship axially of resolving roller 100 instead of the circumferentially spaced relationship of FIGS. 10, 11, 13 and 14. A short staple clamping roller 67 is driven by its shaft 670 and a long staple clamping roller 77 is driven by its shaft 770. A common counter element 394 is provided and carries a divider strip 395 separating the two feed paths. In place of divider 395, the counter member could carry a pair of parallel channels, the lateral walls of each channel being spaced apart a distance slightly greater than the axial width of the corresponding clamping roller. Funnels 68 and 78 supply sliver to the respective feed paths 6 and 7. In this instance of axially staggered clamping elements, the resolving roller has a greater than normal axial width and the fiber feed channel 17 leading to the spinning element (not shown) is tapered in the axial direction.

Figure 18:
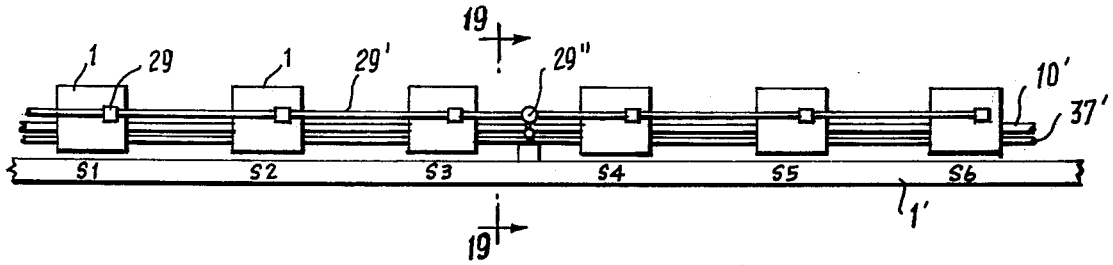
FIG. 18 is a diagrammatic front elevation of a multiple station spinning machine showing a representative common setting device for the sliver supply apparatus.
Figure 19:
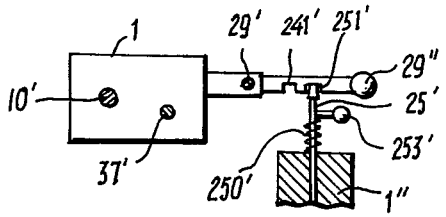
FIG. 19 is an axial section taken on line 19—19 of FIG. 18.

FIGS. 18 and 19 show representative mechanism for interconnecting a plurality of spinning stations $S_1 \ldots S_6$ for simultaneous central setting of the supply apparatus for the desired average staple length. The housings 1 for the spinning stations are supported on machine frame 1'. In conventional manner, a continuous drive shaft 10' for all of the resolving rollers is provided. Similarly, a continuous roller 37' for the corresponding driven rollers of the supply apparatus is provided. This could be a roller frictionally engageable with or carrying the rollers 37 of FIGS. 6, 7, 8, and 9, or could be the shaft 21 of FIGS. 1, 2, 3 and 4. If the setting mechanism is the push-pull lever 29 of FIG. 7, the outer lever ends could be interconnected by a rod 29'. Such a continuous member could similarly interconnect arms 24 (FIGS. 1, 2 and 8) or levers 33 (FIG. 3) or cam track 4 (FIG. 5) or constitute shaft 352 for eccentric cam disks or a cam cylinder (FIGS. 4 and 6) or 414 (FIG. 9) or constitute funnel pivot 740 (FIGS. 11 and 13). A handle 29" is provided to move the setting member 29' for selecting the desired clamping elements of the spinning stations. Illustrative detent means 25', 252', 253', 241', 251' carried by frame member 1" for securing the setting handle in the desired position are shown in FIG. 19. While setting knob 29" is shown centrally of the spinning stations, it could be located anywhere along the length of the machine and is preferably located adjacent to the main control panel (not shown) for the entire spinning machine.

We claim:

1. In a spinning machine having sliver-resolving apparatus including a resolving roller, a first member and a second member cooperating with the first member to form a first sliver-feeding champing nip spaced from the resolving roller at an interval corresponding to the length of long fibers to be spun, one of such members being a driven roller for feeding sliver to the resolving roller, the improvement comprising a third member cooperating with the first member to form a second sliver-feeding champing nip spaced from the resolving roller at an interval corresponding to the length of short fibers to be spun, and selecting means for rendering said second clamping nip active or inactive on sliver being fed to the resolving roller.

2. In the spinning machine defined in claim 1; the selecting means selectively effecting supply of sliver to the first nip or to the second nip.

3. In the spinning machine defined in claim 1, a plurality of spinning stations each having a resolving roller, the improvement further comprising each of the spinning stations including a plurality of sliver feeding members cooperating to form a plurality of nips and selecting means for selecting whether or not the nip closer to the resolving roller will be in action by engagement with the cooperating sliver feeding members, and control means connected with each of said selecting means for simultaneously setting a plurality of said selecting means.

4. In the spinning machine defined in claim 1, one of the cooperating members being a counter member and the other two members being clamping members spaced at different intervals from the resolving roller and engageable with said counter member.

5. In the spinning machine defined in claim 4, the clamping members being spaced apart generally circumferentially of the resolving roller and disposed at opposite sides of the counter member.

6. In the spinning machine defined in claim 5 movable funnel means operable to direct sliver toward a selected one of the clamping members.

7. In the spinning machine defined in claim 4, an elongated feed plate having its length disposed generally radially of the resolving roller forming the counter member, and clamping rollers spaced apart generally circumferentially of the resolving roller and disposed at opposite sides of said feed plate forming the clamping member.

8. In the spinning machine defined in claim 7, biasing means for biasing the rollers toward the feed plate, stop means for limiting the extent of movement of the rollers in opposition to said biasing means, and lever means for engaging the feed plate and selectively moving it away from one of the rollers.

9. In the spinning machine defined in claim 8, selecting means for directing sliver toward a selected one of the rollers, and switch means operable by said selecting means for conditioning the lever means for moving the feed plate away from such selected one of the rollers.

10. In the spinning machine defined in claim 4, the clamping members being driven rollers for feeding sliver to the resolving roller.

11. In the spinning machine defined in claim 4, the clamping member located closer to the resolving roller being movable out of engagement with the counter member.

12. In the spinning machine defined in claim 11, the counter member including a pair of spaced flanges projecting therefrom in a direction substantially parallel to the path of the sliver traveling over the counter member and for a distance to embrace the clamping member closest to the resolving roller in its position moved out of engagement with the counter member.

13. In the spinning machine defined in claim 12, a driven roller forming the counter member, and idler rollers forming the clamping members, one of said idler rollers having a peripheral friction surface engageable with the flanges.

14. In the spinning machine defined in claim 12, wherein the counter member and the clamping members are provided with a synthetic plastic coating, the clamping of members being in continuous frictional contact with both of the spaced flanges.

15. In the spinning machined defined in claim 11, the counter member including a feed plate displaceable generally radially of the resolving roller.

16. In the spinning machine defined in claim 11, the counter member including a feed plate, a pivot supporting the outer end of said feed plate, and the inner end portion of said feed plate being in engagement with the periphery of an eccentric disc cam.

17. In a spinning machine having sliver resolving apparatus including a resolving roller, clamping means and a counter member cooperating to form a nip, the counter member being a driven roller for feeding sliver to the resolving roller, the improvement comprising the clamping means including a leaf spring having a plurality of salient bends forming a plurality of clamping members which clamping members are spaced from the resolving roller at different fiber length intervals, and means for moving the clamping member located closest to the resolving roller out of engagement with the counter member.

18. In a spinning machine having sliver resolving apparatus including a resolving roller and means for supplying fiber sliver to the resolving roller, the improvement comprising the sliver supply means including a plurality of fiber feeding clamping nips located at different intervals from the resolving roller, which intervals correspond to lengths of fibers to be spun, and selecting means for rendering the nip closest to the resolving roller active or inactive on sliver being supplied by the sliver supply means to the resolving roller.

19. In the spinning machine defined in claim 18, the plurality of nips including a corresponding plurality of clamping members and a common counter member.

20. In the spinning machine defined in claim 19, holder means for carrying two of the clamping members and for selectively moving one of the clamping members into or out of engagement with the counter member.

21. In the spinning machined defined in claim 19, holder means for carrying two of the clamping members and for selectively moving the clamping members alternately into engagement with the counter member.

22. In the spinning machine defined in claim 21, pivot means swingably supporting the holder means, the clamping members being located on the holder means symmetrically relative to said pivot means.

23. In the spinning machine defined in claim 19, the clamping member closest to the resolving roller being movable away from the common counter member, and the selecting means being operable to effect movement of such clamping member away from such counter member.

24. In the spinning machine defined in claim 23, the counter member including a feed plate, and a cam track slidably carrying said feed plate, said track being displaceable generally radially of the resolving roller.

25. In the spinning machine defined in claim 18, a plurality of spinning stations each having a resolving roller, sliver supply means and selecting means for rendering the nip closest to the resolving roller active or inactive on the sliver, the improvement further comprising control means common to the selecting means of a plurality of spinning stations for effecting simultaneous operation of such selecting means.

* * * * *

UNITED STATES PATENT OFFICE

CERTIFICATE OF CORRECTION

Patent No. 4,050,228 Dated September 27, 1977

Inventor(s) Hans Landwehrkamp, W. Gerhard Hoeber, Georg Goldammer and Rudolf Oexler It is certified that error appears in the above-identified patent and that said Letters Patent are hereby corrected as shown below:

Title page, [56] References Cited, cancel "Bacil" and insert --Bucil--.

Column 14, line 29, cancel "champing" and insert --clamping--; line 35, cancel "champing" and insert --clamping--; line 40, cancel the semi-colon after "claim 1" and insert a comma; line 63, insert a comma after "claim 5".

Column 15, line 4, cancel "member" and insert --members--; line 38, cancel "of" after "clamping".

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*